United States Patent [19]

Pabst

[11] 4,096,669

[45] Jun. 27, 1978

[54] MEMBRANE BUILDING SEGMENT CONNECTION

[75] Inventor: Alton L. Pabst, Sarasota, Fla.

[73] Assignee: Seaman Corporation, Sarasota, Fla.

[21] Appl. No.: 813,319

[22] Filed: Jul. 6, 1977

[51] Int. Cl.[2] ..... E04B 1/347; E04B 7/14

[52] U.S. Cl. ..... 52/63; 135/15 CF

[58] Field of Search ..... 52/63, 80, 2, 86, 222, 52/57; 135/1 R, 8, 15 CF

[56] References Cited

U.S. PATENT DOCUMENTS

| | | | |
|---|---|---|---|
| 3,169,542 | 2/1965 | Neumark | 135/15 CF |
| 3,227,169 | 1/1966 | Fischer | 135/15 CF X |
| 3,496,686 | 2/1970 | Bird | 135/15 CF X |
| 3,564,784 | 2/1971 | Mollinger | 52/63 |
| 3,805,816 | 4/1974 | Nolte | 135/1 R |
| 3,872,634 | 3/1975 | Seaman | 52/222 |
| 3,965,625 | 6/1976 | White | 135/15 CF X |
| 3,973,364 | 8/1976 | Seaman | 52/57 |
| 4,041,653 | 8/1977 | Rain | 135/1 R X |

*Primary Examiner*—J. Karl Bell

*Attorney, Agent, or Firm*—Hamilton, Renner & Kenner

[57] ABSTRACT

A sealed connecting construction for membrane segments covering a building framework of rigid trusses. The side edges of adjoining segments have cables secured thereto and the cables are detachably connected by one or more chain links to clips overlying the outer chord of the truss. The segments are tensioned by catenary cables secured to the bottom edges of the segments and extending between the truss members. The connection is weather-sealed by an overlying membrane strip or strips having tensioning cables along the outer edges anchored to the foundation base.

10 Claims, 5 Drawing Figures

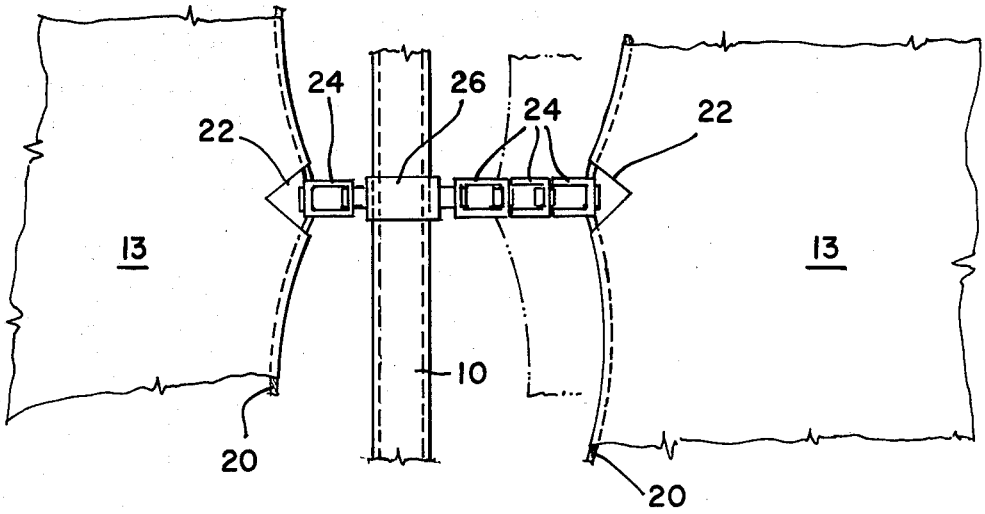
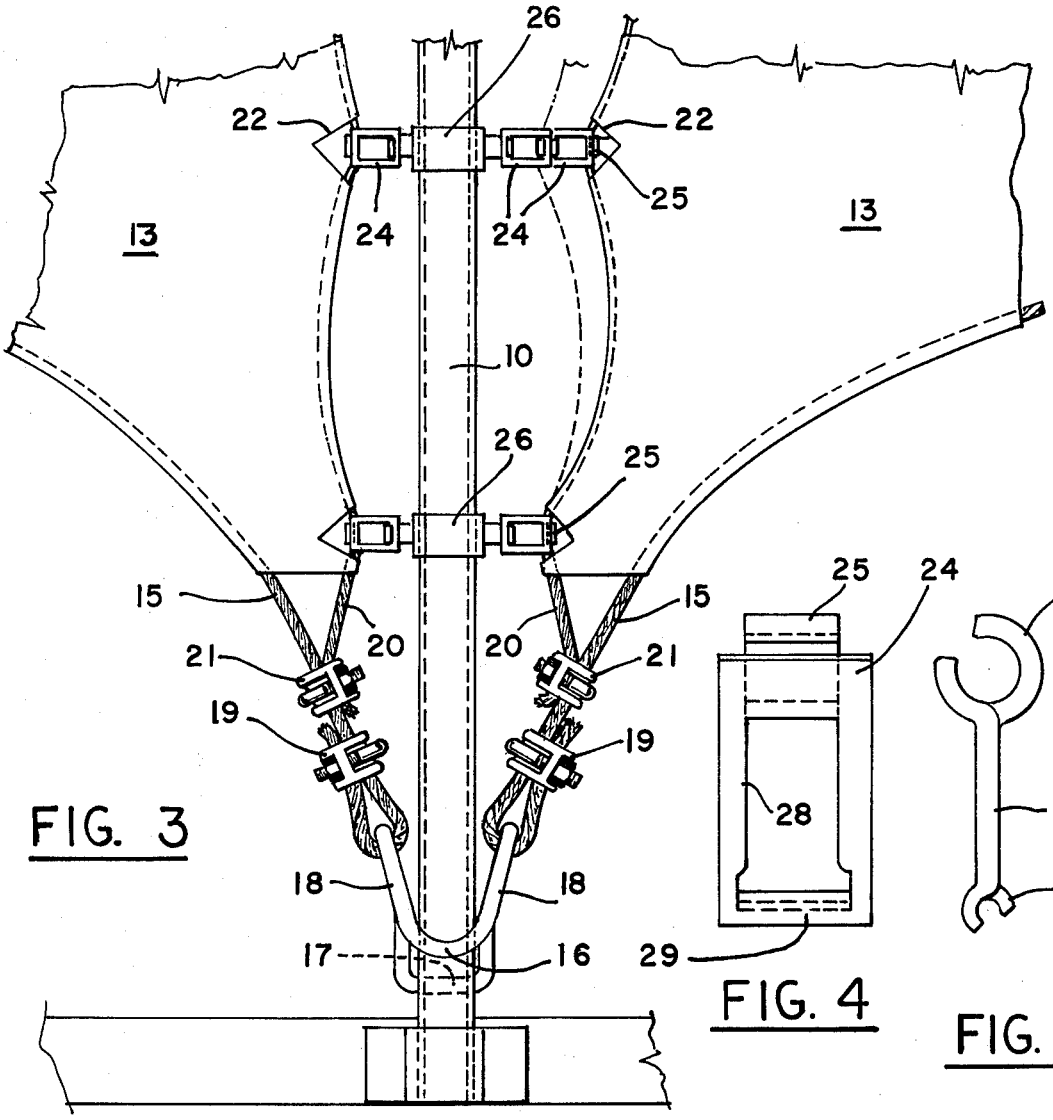
FIG. 3
FIG. 4
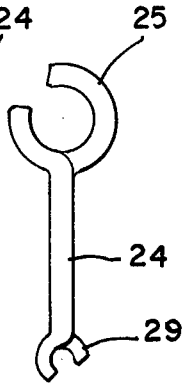
FIG. 5

MEMBRANE BUILDING SEGMENT CONNECTION

BACKGROUND OF THE INVENTION

U.S. Pat. No. 3,872,634, issued Mar. 25, 1975, discloses a rigid building framework having a unitary membrane covering which has certain disadvantages in fabrication, transportation and installation. U.S. Pat. No. 3,973,364, issued Aug. 10, 1976, discloses a sealed joint construction whereby segments of fabric membrane covering the bays between trusses are connected in the field to the trusses and catenary cables in the lower edges of the segments are anchored to the trusses for tensioning the segments. Weather seal strips overlie the joints and have tensioning cables in their side edges to hold the strips down on the segments and restrain the segments against uplift loads.

While the membrane segment and joint construction of U.S. Pat. No. 3,973,364 overcomes a number of the disadvantages of the unitary membrane covering of U.S. Pat. No. 3,872,634, there are still certain difficulties in the field installation of the membrane segments in connecting them at numerous points to the trusses and then uniformly tensioning them by connecting the catenary pull-down cables. Moreover, under extreme conditions the overlying weather seal strips did not provide adequate seals along their side edges with the membrane segments.

SUMMARY OF THE INVENTION

The present invention provides for a more rapid field installation and allows the catenary cables to be connected first and the side edges of the segments to be progressively connected at lower tension and then finally adjusted.

It is an object of the present invention to provide an improved membrane segment connection construction having fewer connecting points with the trusses.

Another object is to provide an improved membrane segment connection construction having adjustable connections between the side edges of the segments and the trusses.

Another object is to provide an improved weather seal strip construction overlying the joint between adjoining membrane segments.

A further object is to provide an improved membrane segment connection construction which is inexpensive to manufacture and which facilitates installation in the field.

These and other objects are accomplished by the improvements comprising the present invention, a preferred example of which illustrating the best known mode of carrying out the invention is shown in the accompanying drawings and described in detail in the following specification. Various modifications and changes in details of construction are comprehended within the scope of the appended claims.

BRIEF DESCRIPTION OF THE DRAWINGS

FIG. 3 is an enlarged partial elevational view at the lower portion of one of the trusses with the weather seal strip means removed.

FIG. 4 is an enlarged plan elevational view of one of the chain links connecting the side edges of the segments to clips embracing the truss chords.

FIG. 5 is a side elevation thereof.

DESCRIPTION OF A PREFERRED EMBODIMENT

Figure 1:
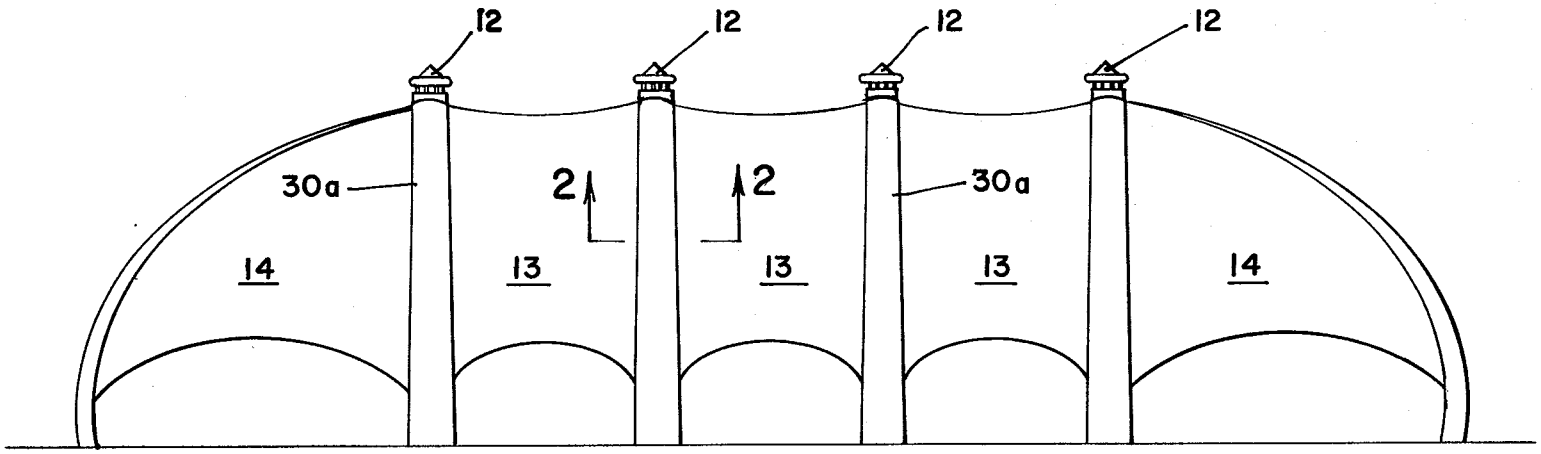
FIG. 1 is a side elevation of a rigid frame, tensioned fabric structure having the improved weather-sealed membrane segment connection.

The domed rigid framework of the present structure may be substantially the same as that shown in prior U.S. Pat. No. 3,872,634, having a plurality of truss members forming side and end bays of a substantially polygonal enclosure. Each truss member has a curvilinear outer chord 10 which supports the membrane cover, and the outer chord may have inclined reinforcing struts 11 which connect the outer chord to inner chord components (not shown herein) extending along the length of the truss member. The truss members preferably are connected at their upper ends to polygonal head members 12, and stringer trusses (not shown herein) preferably connect the head members along the ridge.

The membrane segments for the sides of the building are indicated at 13 and the end segments at 14. A catenary cable 15 attached to the bottom edge of each of the segments applies tension to the segment in a direction parallel to the outer truss chords 10 to which the segment is connected. The ends of the cables of adjoining segments are fastened to a tensioning assembly at the base of the intervening truss member 10, said tensioning assembly being substantially the same as that shown in said prior U.S. Pat. No. 3,872,634. As shown in FIG. 3, the tensioning assembly may comprise a double loop clip 16 having a cross bar 17 welded to the inner surface of the outer truss chord 10, and side loops 18 to which the end loops of adjoining cables 15 are connected, the loops being secured by conventional clamps 19 or the like.

The construction thus far described per se forms no part of the present invention. The improved membrane segment connections at each truss are identical so that only one such assembly need be described in detail. Referring to FIG. 3, the adjoining segments 13 each have cables 20 welded or otherwise secured to their side edges. The cables 20 are anchored at their lower ends, preferably by securing the lower ends to the catenary cables 15 by means of conventional cable clamps 21.

At intervals along the edges of the segments 13 the cables 20 are detachably connected to the intervening truss chord 10. Preferably, the membrane 13 is cut away at the connection points as indicated at 22 to expose the cable, and chain links 24 are connected at one end 25 to the exposed cable. The links 24 are detachably connected to the truss chord 10 by means of U-shaped clips 26 fitting over the chord and having hooks 27 on opposite sides which are engaged through the apertures 28 to the opposite ends 29 of the links.

As shown in FIGS. 4 and 5, the end 29 of each chain link 24 is adapted to be detachably engaged in the hook-like formed in the end 25 of another link 24, and FIG. 3 indicates the manner of using extra links to facilitate installation of the segments. The segment 13 on the left is fully tensioned and installed and the segment on the right is progressively connected at a decreased tension to make the connections with the truss clips 26 easier and more rapid.

Accordingly, the segment is first positioned over top of the framework and initially tensioned a predetermined amount in the direction parallel to the truss chord 10 by connecting the ends of the catenary cables 15 to the double loop clips 16 at the base of the chord. The amount of initial tension is calculated to produce the required final tension in the membrane when the side cables are connected by single chain links to all the truss clips 26. Next, the side cable 20 is connected progressively at the cut-outs 22 to the clips 26 by means of chain links 24. As indicated, one or more additional links may be used to make the initial connections at lower tension so as to require fewer connection points and to facilitate rapid and easy installation.

After all of the connections between the side cable 20 and the truss clips 26 have been made, the additional links 24 may be removed progressively at the several truss clips, using a suitable tool to pull the cable 20 to its final position indicated in phantom lines in FIG. 3, wherein one link is used at each connection and the full required amount of tension is being applied to the segment. The tension is substantially uniform throughout the segment with the contour of the segment being in a saddle shape which withstands both positive loading and negative loading due to wind lift. The particular saddle contour and its advantages are fully described in said prior U.S. Pat. No. 3,872,624.

After the membrane segments have been fully installed and tensioned, side curtain panels (not shown) enclosing the bottom openings below the catenary cables may be installed in a manner similar to that disclosed in said prior U.S. Pat. No. 3,973,364.

Figure 2:
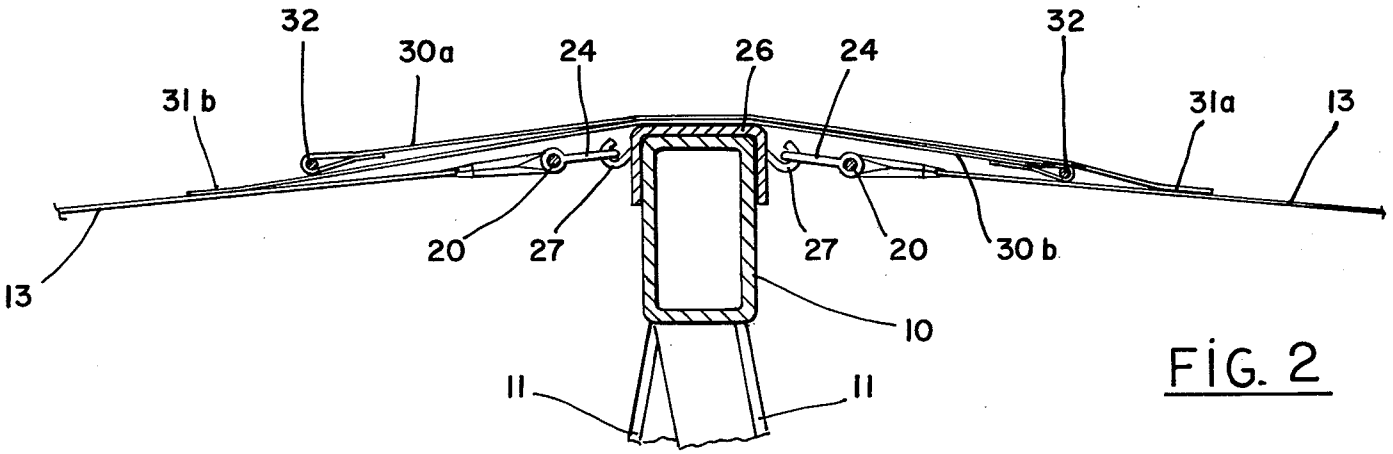
FIG. 2 is an enlarged partial sectional view on line 2—2 of FIG. 1.

As indicated in FIGS. 1 and 2, the improved weather seal strip construction overlying the joint between adjoining segments comprises two strips 30*a* and 30*b* overlapping each other and both strips overlying the connections between the truss chords 10 and adjoining segments 13. Each strip is welded or otherwise secured along one side edge to one adjoining segment 13 or 14 as indicated at 31*a* and 31*b* and has a tensioning cable 32 in the hem extending along the other side edge, the cables being anchored to the base of the truss in a suitable manner. This overlapping double strip weather seal construction provides a much more effective seal against the entrance of moisture and dust than the single weather seal strip of said U.S. Pat. No. 3,973,364.

What is claimed is:

1. In a sealed joint structure connecting adjoining membrane segments, an upright truss member forming part of a supporting framework and having an outer chord, attaching clips mounted at intervals along the chord, and link means detachably connecting the side edges of two adjoining segments to said clips under tension, catenary hold-down cables extending along the bottom edges of said segments and having their ends anchored to said framework, said link means comprising links adapted to detachably engage with like links for permitting the use of additional links facilitating progressively connecting the adjoining segments to the truss chord under decreased tension.

2. In a sealed joint structure as defined in claim 1, wherein said links have openings and said attaching clips have hooks engaged therein.

3. In a sealed joint structure as defined in claim 1, wherein said segments have cables secured to their side edges and said links are secured to said cables.

4. In a sealed joint structure as defined in claim 3, wherein said links have openings and said attaching clips have hooks engaged therein.

5. In a sealed joint structure as defined in claim 1, wherein weather seal strip means of flexible membrane is provided overlying and coextensive with said truss outer chord and overlapping the side edges of adjoining segments.

6. In a sealed joint structure as defined in claim 5, wherein the weather seal strip means comprises overlapping strips each having one side edge secured to one of the adjoining segments, and a tensioning cable secured to its opposite side edge.

7. In a sealed joint structure as defined in claim 1, wherein said links have openings and said attaching clips have hooks engaged therein and wherein weather seal strip means of flexible membrane is provided overlying and coextensive with said truss outer chord and overlapping the side edges of adjoining segments.

8. In a sealed joint structure as defined in claim 7, wherein the weather seal strip means comprises overlapping strips each having one side edge secured to one of the adjoining segments, and a tensioning cable secured to its opposite side edge.

9. In a sealed joint structure as defined in claim 1, wherein said segments have cables secured to their side edges and said links are secured to said cables and wherein weather seal strip means of flexible membrane is provided overlying and coextensive with said truss outer chord and overlapping the side edges of adjoining segments.

10. In a sealed joint structure as defined in claim 9, wherein the weather seal strip means comprises overlapping strips each having one side edge secured to one of the adjoining segments, and a tensioning cable secured to its opposite side edge.

* * * * *